United States Patent [19]

Ruokolainen et al.

[11] 4,396,161

[45] Aug. 2, 1983

[54] DISK REFINER

[75] Inventors: Pekka Ruokolainen; Juhani Kyytsönen, both of Savonlinna, Finland

[73] Assignee: Enso-Gutzeit Osakeyhtiö , Helsinik, Finland

[21] Appl. No.: 247,408

[22] Filed: Mar. 25, 1981

[30] Foreign Application Priority Data

Mar. 25, 1980 [FI] Finland ..... 800912

[51] Int. Cl.[3] ..... B02C 7/12

[52] U.S. Cl. ..... 241/81; 241/245

[58] Field of Search ..... 241/81, 163, 244, 245, 241/247

[56] References Cited

FOREIGN PATENT DOCUMENTS

| | | | |
|---|---|---|---|
| 2711567 | 9/1977 | Fed. Rep. of Germany | 241/247 |
| 51218 | 8/1976 | Finland . | |
| 1039180 | 10/1953 | France | 241/245 |
| 586216 | 12/1977 | U.S.S.R. | 241/247 |

*Primary Examiner*—Howard N. Goldberg

*Attorney, Agent, or Firm*—Toren, McGeady and Stanger

[57] ABSTRACT

Disk refiner for cellulose, paper or other equivalent pulp, with two mutually opposed blade disks, at least one of which is rotatable, carrying grinding surfaces facing each other and having within the circumference defined by the grinding surface of one blade disk, in the pulp inlet duct, a sieve plate concentric with the blade disks. Within the sieve plate there is a concentric guide plate so that between the sieve plate and the guide plate there is defined a gap through which the pulp to be refined goes to the grinding surfaces.

7 Claims, 4 Drawing Figures

DISK REFINER

The present invention concerns a disk refiner intended for cellulose, paper or other equivalent pulp and comprising two opposed blade disks, at least one of them being rotatable, which blade disks have grinding surfaces facing each other, and wherein within the circumference furnished by the grinding surface of one blade disk in the pulp entrance duct there is provided a sieve plate concentric with the blade disks.

A disk refiner is in regard to its structural aspects an advantageous solution when fibre suspensions of the above-mentioned substances are to be refined. Dewatering of the pulp stock, resulting in a high dry matter content, or consistency, before or after the grinding process would save energy and improve the quality of the pulp. The problem is however that when using conventional disk refiners in high consistency refining it is necessary to have before the refining step a concentrator which is an expensive piece of equipment.

With a view to eliminating this problem, Finnish Pat. No. 51218 discloses a pulp concentration means comprising a conveyor screw disposed within a sieve cylinder, this screw being used to supply the pulp into the refiner. Owing to the rotation of the sieve cylinder, the means operates like a centrifuge so that the centrifugal force acting on the pulp increases and the separation of water is enhanced. However, the use of a screw within the sieve cylinder introduces the detriment that, considering the risk that the sieve holes become clogged, the gap between the ridges of the screw and the sieve cylinder cannot be made very narrow, although this would be advantageous with a view to efficient dewatering.

The object of the present invention is to provide a disk refiner in which the above-mentioned drawback has been eliminated.

The disk refiner of the invention is characterized in that inside the sieve plate there is a concentric guide plate so that between the sieve plate and the guide plate there is defined a gap along which the pulp to be refined goes to the grinding surfaces.

An advantageous embodiment of the invention wherein one of the two blade disks is a stator and the other is a rotor, is characterized in that the sieve plate has been affixed to the rotor and the guide plate to the stator. In that case the sieve plate will give rise to a centrifugal force acting on the pulp.

Another embodiment of the invention is characterized in that the sieve plate is affixed to the stator and the guide plate to the rotor.

One embodiment of the invention is further characterized in that in the cylindrical gap defined by the sieve plate and guide plate have been provided with members preventing clogging of the sieve plate. It is contemplated that there may be used as such members, members which cause a pulsating effect in the holes of the sieve plate. The pulsation gives rise, in the holes of the sieve plate, to a rapid differential pressure fluctuation, by the effect of which the holes remain open.

One embodiment of the invention is also characterized in that the guide plate has on its surface eminences or protuberances shaped like spherical nodules and which produce the pressure pulsation at the sieve plate and keep the sieve plate holes open.

The invention is described in the following with reference to the attached drawings, presenting a disk refiner according to the invention and wherein:

FIG. 1 presents the disk refiner according to an embodiment of the invention, displayed as sectioned.

Figure 1:
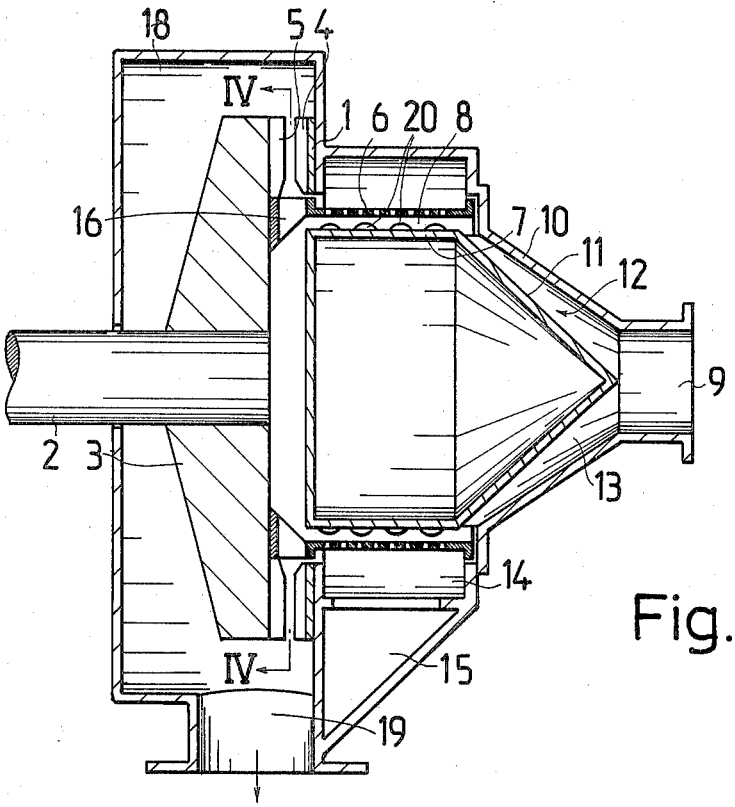

Referring now to FIG. 1, the disk refiner therein depicted has one stationary blade disk 1 and one rotatable blade disk 3, mounted on a shaft 2, these disks having blade surfaces 4 and 5 facing each other and grinding the pulp. Within the circumference defined by the blade surface 4, in the pulp entry duct, there is a cylindrical, rotating sieve plate 6. Within the sieve plate 6 there is disposed a concentric guide plate 7, whereby between the sieve plate 6 and the guide plate 7 there is defined a cylindrical gap 8, through which the pulp that has to be refined goes to the grinding surfaces 4,5.

Figure 3:
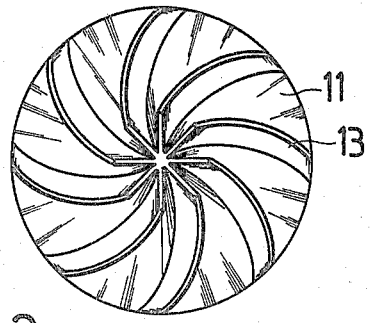
FIG. 3 shows the section carried along the line III—III in FIG. 2.

The pulp is introduced into the refiner under pressure through the pipe 9, with a consistency of 2 to 3%. The flow expands to a conical configuration in the space 12 enclosed between the conical jacket 10 constituting an extension to the pipe 9, and a cone 11 affixed to the guide plate 7. The cone 11 has been affixed to the conical jacket 10 by means of curved flow guiding vanes 13 (FIG. 3), by effect of which the pulp is set in rotary motion with a direction of movement having the same direction as the rotation of the sieve 6. Since the space 12 tapers down in the direction of pulp supply, the flow velocity of the pulp suspension increases as its enters the gap 8. It follows that the suspension supplied has in the gap 8 a high velocity in the direction of rotation of the sieve.

Figure 4:
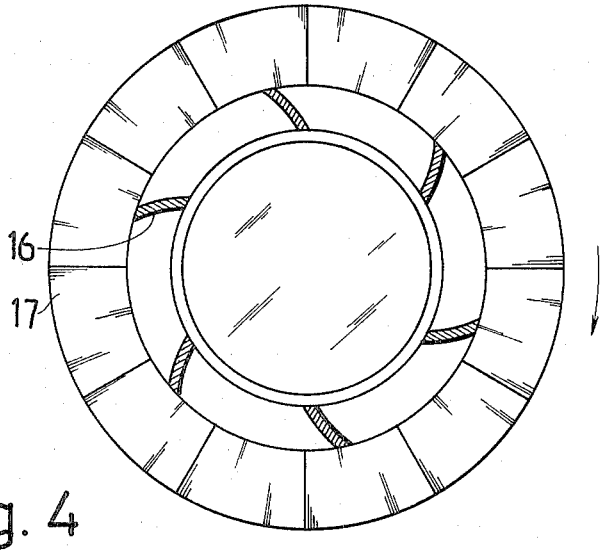
FIG. 4 shows the section carried along the line IV—IV in FIG. 1.

In the gap 8, the pulp suspension is directed against the sieve plate 6, which operates like a centrifuge, being affixed to the rotating disk 3 of the refiner. As a result, the water entrained with the pulp travels through the holes of the sieve 6 into the chamber 14 and thence further out through the discharge opening 15 of the refiner. The pulp that has become concentrated on the sieve surface, in its turn, passes through the apertures 17 between the supply vanes 16 connecting the sieve plate 6 with the rotating disk 3, into the grinding gap between the grinding surfaces 4 nd 5. The conveying of the pulp into the grinding gap has been boosted in that, as shown in FIG. 4, the supply vanes 16 have been inclined, as viewed in the direction of rotation of the blade disk 3, from the outer periphery of the blade disk 3 towards the centre, whereby the pulp discharging through the apertures 17 meets a lower flow resistance in the direction towards the grinding gap. The pulp flung out from the gap between the blades is collected in the refiner chamber 18, whence it is drained through the aperture 19.

In order to prevent blocking of the rotating sieve plate 6, there have been mounted on the guide plate 7, knobs 20 producing pressure fluctuations, these knobs having advantageously the shape of buttons shaped like a spherical nodule. Such pulsing members are efficient in keeping the sieve holes open, whereby the water separation from the pulp is powerful over the entire sieve area—also at the end adjacent to the grinder blades. Depending on the pulp grade and on the hole size of the sieve, a refining consistency between 8 and 12% is obtained.

It is to be understood that it is possible to use for the sieve plate: a hole sieve, a slit sieve, or sieves with another kind of pattern. Likewise, the members producing pressure pulsation may be, not only nodules having a spherical shape, but also e.g. streamlined members resembling an airfoil.

Moreover, the apparatus may be so constructed that the filtrate coming through the sieve and the pulp passing through the refiner's blades are removed through different discharge apertures.

It is possible by appropriate selection of the sieve's hole size, to let pass the finest constituent particles of the pulp suspension which need not be comminuted and ground. They are then not injured in the blade gap, and only that part of the suspension is carried into the blade gap which needs to be treated. Such elimination of useless grinding work conserves energy and improves the properties of the pulp coming out of the refiner since only that part is ground which must be ground. This carries great significance in reject refining for instance.

Figure 2:
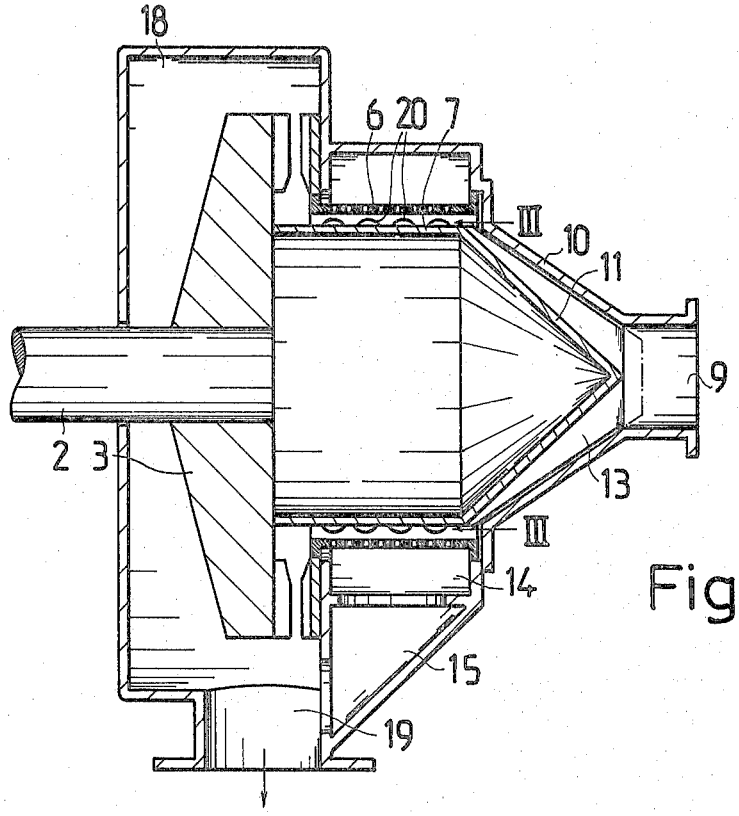
FIG. 2 shows the disk refiner of another embodiment, sectioned.

In the embodiment of FIG. 2, the sieve plate 6 has been affixed to the stator 1 and it is therefore stationary. On the other hand, the guide plate 7 inside the sieve plate 6 has been affixed to the rotor 3 and therefore rotates along with the rotor. The supplying of pulp, the water separation and the grinding take place in principle as has been described in the preceding embodiment.

It is obvious to a person skilled in the art that different embodiments of the invention may vary within the scope of the claims stated below.

What is claimed is:

1. In a disk refiner for cellulose, paper or other equivalent pulp including two mutually opposed blade disks, one of which is rotatable and acts as a rotor and the other of which acts as a stator, a pulp inlet duct, opposed grinding surfaces facing each other formed on said blade disks, and a sieve plate concentric with said blade disks located within the circumference defined by the grinding surface of one of said blade disks in the pulp inlet duct, the improvement comprising that within said sieve plate there is a concentric guide plate so that between the sieve plate and the guide plate there is defined a gap along which the pulp to be refined passes to the grinding surfaces, and wherein the sieve plate is affixed to the grinding disk acting as a rotor and the guide plate is affixed to the grinding plate acting as a stator.

2. The improvement according to claim 1 wherein said sieve plate is affixed to said blade disk acting as a rotor by means of feed vanes on said rotating blade disk.

3. The improvement according to claim 2 wherein between said feed vanes there are provided apertures by which the pulp discharges into the gap between the grinding surfaces.

4. The improvement according to claim 3 wherein the feed vanes are inclined, as viewed in the direction of rotation of said blade disk acting as a rotor, from the outer periphery of said rotating blade disk toward its center.

5. The improvement according to claim 1 further comprising members located in the gap defined between the sieve plate and the guide plates operating to keep said sieve plate clean.

6. The improvement according to claim 5 wherein said members keeping said sieve plate clean are protuberances on the surface of said guide plate which cause in the sieve plate a pressure pulsation due to which the holes in the sieve plate remain open.

7. The improvement according to claim 6 wherein said protuberances are in the shape of spherical nodules.

* * * * *